US005467940A

United States Patent [19]

Steuer

[11] Patent Number: 5,467,940

[45] Date of Patent: Nov. 21, 1995

[54] ARTILLERY ROCKET

[75] Inventor: Raimar Steuer, Leinburg, Germany

[73] Assignee: Diehl GmbH & Co., Nuremberg, Germany

[21] Appl. No.: 278,779

[22] Filed: Jul. 22, 1994

[30] Foreign Application Priority Data

Jul. 28, 1993 [DE] Germany ..... 43 25 218.4

[51] Int. Cl.[6] ..... F41G 7/20; F42B 10/64; F42B 10/34

[52] U.S. Cl. ..... 244/3.11; 244/3.21; 244/3.24; 102/384; 102/385

[58] Field of Search ..... 244/3.1, 3.11, 244/3.15, 3.21, 3.24; 102/384, 385

[56] References Cited

U.S. PATENT DOCUMENTS

| | | | |
|---|---|---|---|
| 3,067,681 | 12/1962 | Beman | 102/49 |
| 3,272,124 | 9/1966 | Marsh et al. | 102/50 |
| 4,394,997 | 7/1983 | Maudal | 244/3.16 |
| 4,438,893 | 3/1984 | Sands et al. | 244/3.21 |
| 4,606,514 | 8/1986 | Sundermeyer | 244/3.15 |
| 4,662,580 | 5/1987 | Nelson | 244/3.1 |
| 4,840,328 | 6/1989 | Sundermeyer | 244/3.15 |
| 4,856,733 | 8/1989 | Lachmann | 244/3.15 |
| 4,883,239 | 11/1989 | Lachmann et al. | 244/3.15 |
| 4,923,142 | 5/1990 | Creusot et al. | 244/3.1 |
| 5,322,243 | 6/1994 | Stoy | 244/3.24 |

FOREIGN PATENT DOCUMENTS

| | | | |
|---|---|---|---|
| 0547637 | 6/1993 | European Pat. Off. . | |
| 1528934 | 5/1968 | France . | |
| 2611886 | 9/1988 | France . | |
| 2623280 | 5/1989 | France . | |
| 3229474 | 2/1983 | Germany . | |
| 3645093 | 9/1987 | Germany . | |
| 3904684 | 9/1990 | Germany . | |
| 4120367 | 12/1992 | Germany . | |
| 2039056 | 7/1980 | United Kingdom . | |
| 2073382 | 10/1981 | United Kingdom | 244/3.15 |
| 2184414 | 6/1987 | United Kingdom . | |
| 2190636 | 11/1987 | United Kingdom . | |

OTHER PUBLICATIONS

Pengelley, R., "Europe and U.S. vie in 155mm Artillery Ammunition Innovation," *International Defense Review 26(7): 563–568 (1993).*

Regan, F. J., "Aeroballistics of a Terminally Corrected Spinning Projectile (TCSP)," *J. Spacecraft and Rockets* 12(12): 733–738 (1975).

Mraz, Stephen J., "Projecting Power Across the Water," *Machine Design*, Dec. 7, 1989, pp. 76–82.

*Primary Examiner*—Charles T. Jordan
*Assistant Examiner*—Theresa M. Wesson
*Attorney, Agent, or Firm*—Scully, Scott, Murphy & Presser

[57] ABSTRACT

An artillery rocket including a motor for the launching thereof into a ballistic trajectory across a specified target area over which a payload is to be released. The rocket is equipped with a flight controller or autopilot for the control over a rudder or control surface-setting or control system which is actuatable from a navigational receiver with actual positional coordinates. The flight controller operates on a control or setting system which is disposed in front of the warhead in the forward region of the nose cone without noticeably restricting the usable volume for the warhead.

4 Claims, 2 Drawing Sheets

ARTILLERY ROCKET

BACKGROUND OF THE INVENTION

1. Field of the Invention

The present invention relates to an artillery rocket including a motor for the launching thereof into a ballistic trajectory across a specified target area over which a payload is to be released.

2. Description of the Prior Art

A rocket of this type has been introduced into the Western military technology as the MLRS (Multiple Launch Rocket System) basic rocket for ballistically deploying submunition-warheads over a predetermined target area. At the launch of the rocket, which is followed by a short boost phase for acceleration thereof into a ballistic trajectory, the azimuth and elevation of the stowage and launch container of the rocket determine the direction and distance to the target area, over which a trajectory-dependently programmed time fuze triggers a gas generator for ejecting the submunition-warhead from the carrier rocket. System-caused errors, to the extent that they are at all quantitatively detectable, can only be taken into consideration prior to the launch of the rocket; for instance, such as an individual initial starting fault caused by a manufacture defect of the respective rocket, or due to the momentary ground-cross-wind influences which are determinable through a probe designed in accordance with German Laid-open Patent Application No. DE-OS 41 20 367.

However, even taking such disruptive parameters into consideration is subject to errors, and disruptive influences which are encountered during travel of the rocket along the ballistic trajectory after launch can no longer be at all taken into consideration. The foregoing thus results in a certain degree of inaccuracy in the delivery of the payload over the specified target area, which is acceptable to the extent in that the deployed payload relates to scatter munition (bomblets and scatter mines). However, it is precisely due to that reason that the employment of this introduced ballistically flying artillery rocket in intermeshing conflict areas is hardly acceptable, inasmuch as consideration must be given to highly accurate attacks on specified target areas.

SUMMARY OF THE INVENTION

In recognition of the foregoing factors, the present invention is therefore based on the object of attaining an increase in the degree of precision of a rocket of generally the type set forth, while retaining the currently utilized system components.

In a rocket of the type as set forth herein, this object is attained in that the rocket is equipped with a flight controller or autopilot for the control over a rudder or control surface-setting or control system which is actuatable from a navigational receiver with actual positional coordinates.

In accordance with the foregoing object, the rocket is equipped with a flight controller or autopilot whose technical demands and complexity can remain comparatively low, inasmuch as it is supported by a precise radio navigational system which delivers not only a reference for the current or actual trajectory coordinates, but in particular also for the positional, or respectively, point-in-time for the delivery of the payload.

In order to achieve such an increase in the level of precision not only without any substantial modifications of or interventions in the presently introduced MLRS-system, but also without significant modifications in the structure of the basic rockets, the flight controller operates on a control or setting system which is disposed in front of the warhead in the forward region of the nose cone without noticeably restricting the usable volume for the warhead. The design of the rocket in the region of its rocket motor remains consequently completely unaffected to the extent that the rudders or control surfaces on which the flight controller acts are designed as canards which are comparatively extensively elongated along the longitudinal direction or length of the rocket. The short wing span width of the former allows them to be disposed in the stowage space and launching container of the rockets without the need to have recourse to structurally complicated flap mechanisms. In the event that after the rocket has flown through the ballistic apogee the canard rudders have been placed into a condition deviating from their initial neutral position in order to facilitate the trajectory corrections which are determined by the flight controller, for the dependable attainment of the predetermined target coordinates, there is resultingly obtained an additional aerodynamic lift which leads to an extension of the trajectory curve and thereby, additionally, to the increase in the degree of accuracy, also to a substantial increase in range so that the therefrom resultant reduction in logistic costs extensively overcompensates for the higher expenditure in equipment for the basic rockets.

BRIEF DESCRIPTION OF THE DRAWINGS

Additional alternatives and developments and further features and advantages of the invention will become apparent from the following description of a preferred embodiment of the invention; taken in conjunction with the accompanying drawings in which.

DETAILED DESCRIPTION

Figure 1:
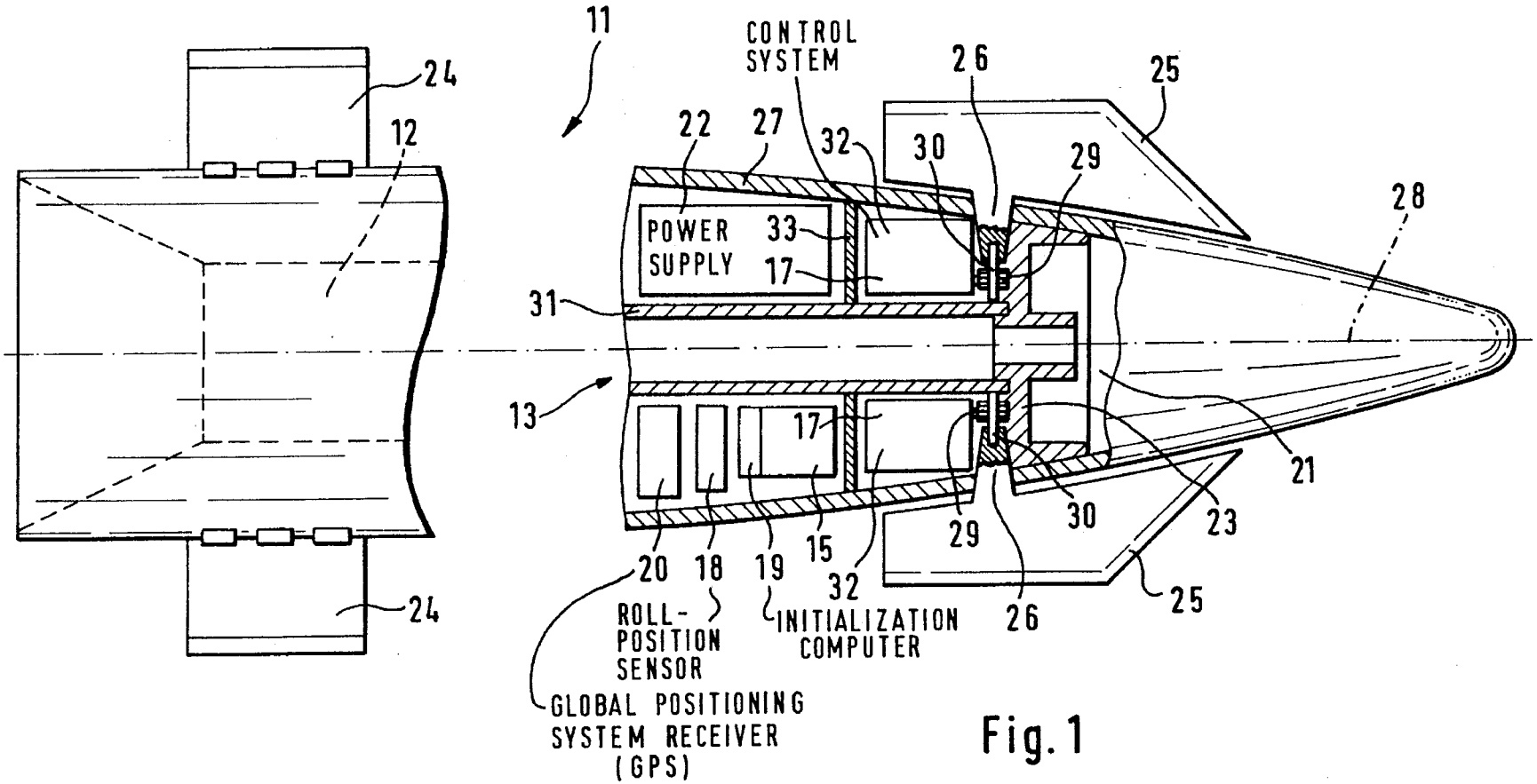
FIG. 1 is a partial view, shown in a partly axial longitudinal section, of a rocket which is equipped with a satellite navigation-supported flight controller for the actuation of canard rudders or control surfaces.

The rocket 11 of the MLRS-artillery rocket system which is currently deployed in the Western world (also referred to as the medium artillery rocket system MARS) is basically a missile which is very slender; in essence, extremely lengthy in comparison with its diameter, although this is not fully apparent in view of the segmented representation thereof in FIG. 1. Immediately after being fired from the stowage and launch container, the rocket 11 is accelerated for a period of time in the order of magnitude of only about two seconds through its solid fuel-rocket motor 12 which extends approximately along the rear half of the missile length, in order to then fly in a non-driven condition along a ballistic trajectory to a position over the predetermined target area and to there deliver the active bodies therein (bomblets, drop mines or end phase-guided submunition missiles), due to the rocket hull laterally breaking apart or rupturing.

Figure 2:
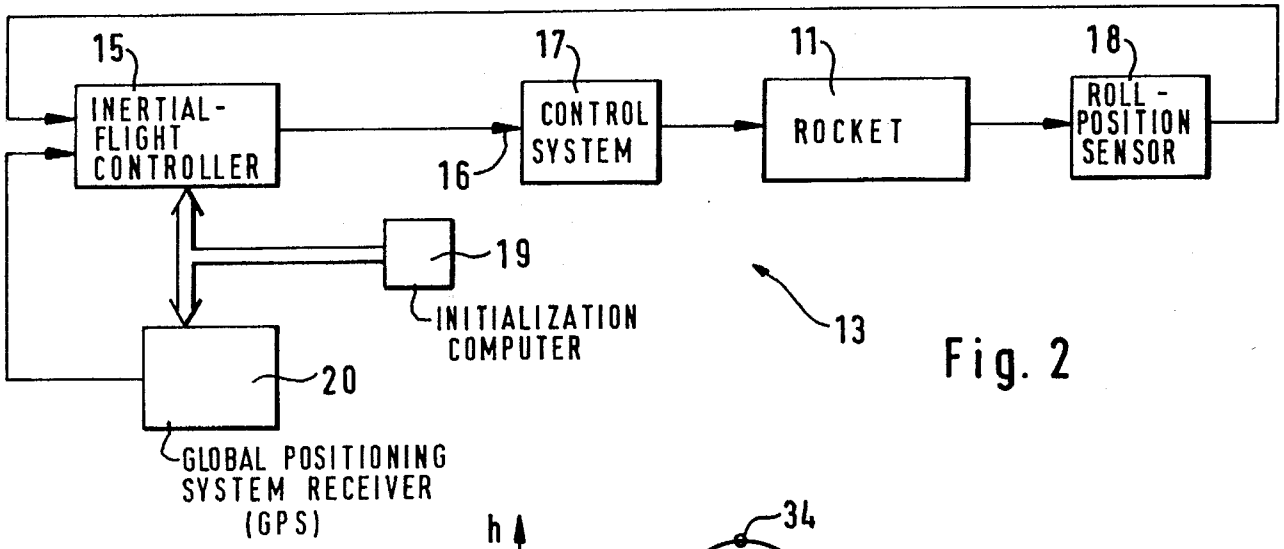
FIG. 2 is a block circuit diagram of a simplified control loop for the typical control of the rocket of FIG. 1 as equipped in accordance with the invention.
Figure 3:
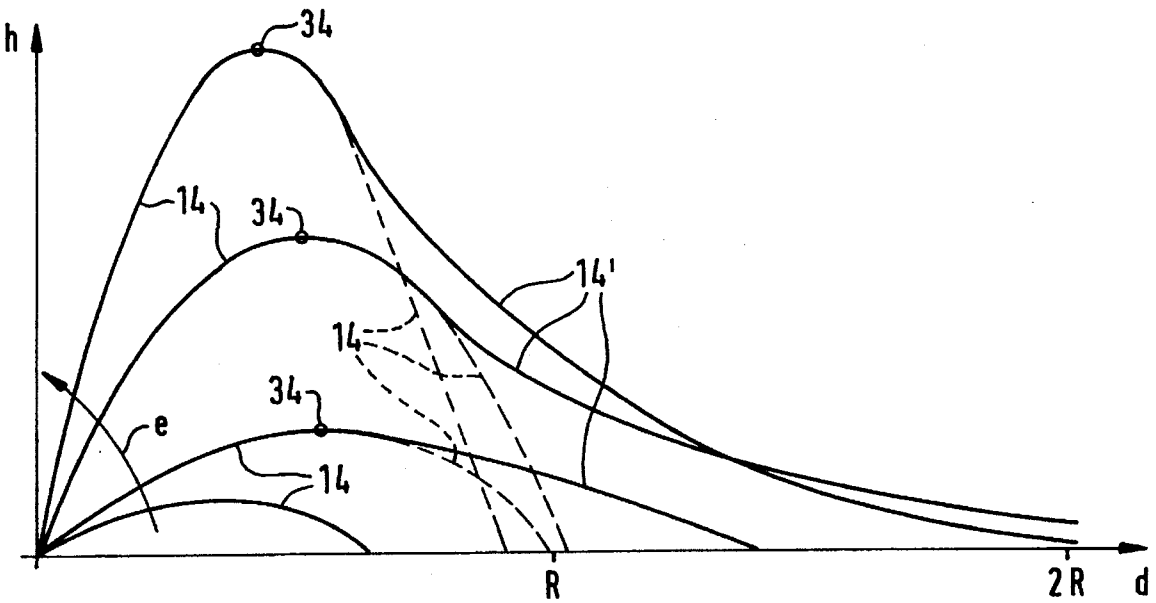
FIG. 3 shows a plot of the trajectory profile relative to range in dependence upon the launching elevation of the rocket with trajectory control generally as in FIG. 2.

In order to reach this predetermined target area in a more dependable manner, the rocket 11 is inventively equipped with an active inertial-trajectory guidance system 13 which, at launching, has a reference trajectory specified therewith in the presence of the target coordinates, and which as the rocket approaches the target area is able to correct influences of any errors which are in particular derived from launching disruptions and disturbing wind influences which, in the case of an uncorrected flight, can lead to an offsetting or deviating displacement in the ballistic trajectory 14 (referring to FIG. 3). In contrast therewith, the active trajectory guidance system 13 facilitates a maintenance in position, and positional control throughout the entire flight mission under a constant determination of any kind of deviations from the reference trajectory, and the correcting of any errors which have been encountered, by means of the flight controller 15 which acts with the information received about the control deviation 16 (FIG. 2) for compensation of the former on a control system 17 of the rocket 11. In order to be able to actuate the control system 17 for specified movements in space, the rocket 11 is further equipped with a roll-positional sensor 18 for effectuation on the flight control 15. Immediately prior to the launching of the rocket 11, an initialization computer 19 transmits into the flight controller 15 the specified reference values with regard to the trajectory and delivery point, as well as concerning the current actual values regarding operating parameters, such as launch coordinates and launch elevation, as well as actual disruptive factors, such as may be indicative of errors caused during manufacturing, upon launch of the rocket from the stowage and launch container, and the current crosswind intensity.

The integration of a radio-supported navigational system, such as in particular a Global Positioning System (GPS) receiver 20 into the function of the trajectory guidance system 13 with the inertial-flight controller 15 renders it possible, for the initiation of the gas generator 21 for the lateral ejection of the payload, to extremely accurately determine the firing point with regard to the period of time from the launch of the rocket 11, and/or with regard to the location coordinates of the target area reached by the trajectory 14, and to thereby achieve a high level of accuracy with regard to the specified payload delivery, which could not be achieved with an autonomous traveling time-control commencing operation from rocket launch.

The entire trajectory guidance system 13, inclusive of the electrical power supply 22 and control system 17 is integrated into the front section of the ogive or nose cone of the rocket 11 between the warhead and the gas generator 21 in the space immediately behind the front bulkhead 23, and at that location takes up only a minimal payload space in comparison with the conventional equipment employed in the MLRS-basic rocket 11. The front main bulkhead 23 which connects the gas generator section to the warhead casing is thus completely unchanged and maintained with regard to its shape and function, but is incorporated as an integral component into the structural configuration of the additionally installed trajectory guidance system 13; in particular with respect to the mounting of the control system 17, as described hereinbelow. Disposed behind the foregoing components are the flight controller 15 together with an inertial guidance unit (consisting of pitch and yaw rate gyros, roll position-sensor 18, navigational receiver 20 and data processor), as well as the power supply 22; located in the conically widening section of the ogive or nose cone.

Notwithstanding the increase in requirements for delivery accuracy, the implementation or constructive expenditure with regard to the inertial flight controller 15 can be held comparatively low, inasmuch as during the flight of the rocket 11 the former is updated with accurate actual positional coordinates from the GPS-receiver 20, and the current flight speed can also always be ascertained with a very high degree of accuracy from the GPS-information (change in position through the system time difference).

The stabilization fins 24 which are extendable at the tail end of the rocket 11 after leaving the launch canister are not readily available for conversion to rudders or control surfaces for trajectory control, since in order to do so it would be necessary to intervene in the rocket structure in the region in which the fins are mounted, and it would consequently also be necessary to intervene in the function of the rocket motor 12. Therefore, the region which can be subjected to a high mechanical loading, behind the front main bulkhead 23 in the ogive or nose cone of the rocket 11, is selected for mounting the control system, whereby the control rudders or control surfaces 25 are in the form of canard members. The control rudders 25 engage with shaft portions 26 thereof into the nose cone casing 27 radially oriented with respect to the longitudinal axis 28 of the rocket, and are respectively mounted at that location in front of a control transmission arrangement 29 on a respective pin 30, the latter of which is supported by the tubular internal structure 31 in the region of the warhead of the rocket 11.

In the interest of obtaining a good control performance and high dynamics, the arrangement provides for the control system 17 four control surfaces 25 which can be actuated independently of each other and which are disposed orthogonally relative to each other, and thereby four servo-drives 32 which are mounted between the control transmission arrangements 29 and an additionally installed intermediate bulkhead 33 on the tubular internal structure 31 ahead of the electronic section. That design configuration renders it possible to install small control motors in order to achieve a high level of control system dynamics for pitch and yaw control, in addition to influencing the roll position of the rocket 11. A particularly high degree of dependability, even after a lengthy storage time, is ensured by a potentiometer-free servo drive 32, in accordance with German Patent No. 35 01 156. A device in accordance with German Laid-open Application No. 40 19 482 is preferred for the control transmission arrangement 29, because of the action of a defined and interference-free stroke limitation.

The rearward stabilization fins 24 which are extended under spring-loading only after the launch are mounted without any positioning equipment. The canard rudders or control surfaces 25, upon a rocket launch which is as spin-free as possible, also do not yet have any positioning imparted thereto in order for the rocket to initially fly along the undisrupted ballistic path 14 (at the left in FIG. 3) during and after the boost phase. However, it may be appreciated that, after reaching the height h of the trajectory apogee 34, whereby this height is dependent upon the angle of elevation e, that this would result in a range R which is only slightly variable, and which would even be shortened in the event of an excessively steep launch. In the event, however, that the rudders or control surfaces 25 are imparted a positioning motion by the trajectory control system 13 after attainment of the apogee 34 in order to exert a correcting effect over the trajectory, then the rocket will depart from the originally ballistic trajectory 14 because the lifting action of the rudders or control surfaces 25 which now are in an operative position results in an extended trajectory 14' and thus in an increase in the distance d to approximately twice the range 2 R (FIG. 3). The rocket 11 then travels along the distance due to the aerodynamic lift of the canard control surfaces 25 at an almost constant glide angle precisely over the target area which is specified by the coordinates.

The radial dimension of the canard control surfaces 25 in the conically tapering ogive or nose cone region ahead of the warhead signifies that there is no need for expensive folding wings because the internal width of the stowage and launch container is adequate to accommodate sufficiently projecting canard surfaces or fins. The control system 17 is not yet active during the boost phase. Thereafter, the rocket 11 is accelerated to a multiple of the speed of sound which, however, does not cause any problems with regard to the canard control surfaces since, in essence, they do not first have to be extended, but are already maintained in a play-free condition in their functional position. The length of the canard control surfaces 25, which is short in comparison with the total overall length of the rocket 11, with a high degree of sweepback of their leading edges, so as to ensure that even at high angles of incidence, for the transition from the ballistic trajectory 14 into the extended trajectory 14', there is no danger encountered of any break-off phenomenon in the air stream or flow, but that there are maintained stable and reproducible aerodynamic conditions.

Accordingly, the higher level in the delivery accuracy of this weapon system which, in itself is used as a ballistic rocket, concurrently provides a quite considerable increase in range in a desirable manner. This renders it possible for the launcher to be pulled back into safer positions at a greater distance behind the front or target area, while nonetheless covering a sector with a longer chord in the region of the substantially increased range. This, in turn, means that the sideways distance or spacing between individual launchers can be increased without the formation of gaps in the coverage of the target area. Accordingly, not only are fewer rockets 11 required for comparable levels of performance, because of the higher degree of delivery accuracy, but the number of launch devices also decreases, which readily justifies the higher equipment costs of such an artillery rocket 11 which is more accurate and which provides for an increased range of action.

What is claimed is:

1. An artillery rocket including a warhead carrying a payload; a motor for launching said rocket into a ballistic trajectory above a specified target area over which the payload is to be released, said rocket comprising a flight controller for the control of a control system for a plurality of canard control surfaces; a navigational receiver with actual positional coordinates for actuating said flight controller; said flight controller, said control system for the control surfaces, said navigational receiver, a roll-position sensor, and a power supply being arranged within a casing of a rocket nose cone ahead of said warhead; said control system in conjunction with a control transmission arrangement for the canard control surfaces being mounted between a front main bulkhead of the rocket and a further intermediate bulkhead rearwardly thereof; said canard control surfaces engaging with shaft portions extending radially into the casing relative to the longitudinal axis of said casing, said plurality of said canard control surfaces being settable independently of each other, and each said canard control surface having a separate said transmission arrangement operatively associated therewith.

2. A rocket as claimed in claim 1, wherein said roll-position sensor is operatively superimposed on said flight controller.

3. A rocket as claimed in claim 1, wherein, during the launch phase of said rocket, means transmit target coordinates to the flight controller and launch coordinates to the navigational receiver from an initialization computer in addition to current interference factor information.

4. A rocket as claimed in claim 1, wherein said flight controller implements a transition into an extended trajectory for said rocket at a substantially increased range under a substantially constant glide angle after the rocket has passed through the apogee of the ballistic launch trajectory, through said control surfaces being placed into a position of operational incidence from an initially neutral position.

* * * * *